US009856658B2

(12) United States Patent
Yang

(10) Patent No.: US 9,856,658 B2
(45) Date of Patent: Jan. 2, 2018

(54) FLOORBOARD ASSEMBLY

(71) Applicant: Feng-Ling Yang, Taichung (TW)

(72) Inventor: Feng-Ling Yang, Taichung (TW)

( * ) Notice: Subject to any disclaimer, the term of this patent is extended or adjusted under 35 U.S.C. 154(b) by 0 days.

(21) Appl. No.: 15/062,542

(22) Filed: Mar. 7, 2016

(65) Prior Publication Data

US 2016/0273230 A1 Sep. 22, 2016

(30) Foreign Application Priority Data

Mar. 18, 2015 (CN) ..... 2015 1 0118728

(51) Int. Cl.
*E04F 15/02* (2006.01)

(52) U.S. Cl.
CPC ..... *E04F 15/02044* (2013.01); *E04F 15/02* (2013.01); *E04F 15/02038* (2013.01); *E04F 2201/0153* (2013.01); *E04F 2201/0517* (2013.01)

(58) Field of Classification Search
CPC ..... E04F 15/02; E04F 15/04; E04F 15/02038; E04F 15/02005; E04F 15/02044; E04F 2201/0517; E04F 2201/0153; E04F 2201/042; E04F 2201/025; E04F 2201/0138; E04F 2201/023
See application file for complete search history.

(56) References Cited

U.S. PATENT DOCUMENTS

| | | | | |
|---|---|---|---|---|
| 3,731,445 | A * | 5/1973 | Hoffmann | E04F 15/02 52/391 |
| 6,339,908 | B1 * | 1/2002 | Chuang | E04F 15/04 52/177 |
| 7,805,903 | B2 | 10/2010 | Liu | |
| 8,006,458 | B1 * | 8/2011 | Olofsson | E04F 15/02 52/489.1 |
| 8,276,343 | B2 | 10/2012 | Yang | |
| 2003/0046895 | A1 * | 3/2003 | Haffner | B32B 3/08 52/745.19 |
| 2004/0172904 | A1 * | 9/2004 | Martensson | E04F 15/02 52/384 |
| 2006/0179754 | A1 * | 8/2006 | Yang | E04F 15/02 52/426 |
| 2007/0107359 | A1 * | 5/2007 | Zhang | E04F 15/02 52/582.1 |

(Continued)

FOREIGN PATENT DOCUMENTS

TW M271046 U 7/2005

*Primary Examiner* — Adriana Figueroa
*Assistant Examiner* — Jessie T Fonseca
(74) *Attorney, Agent, or Firm* — Muncy, Geissler, Olds & Lowe, P.C.

(57) ABSTRACT

A floorboard assembly includes floor boards and fasteners. Each floor board includes a rectangular body including a coupling tongue and a coupling groove at two opposite sides, a first pressure block and a second pressure block respectively disposed at a bottom side relative to the coupling tongue and the coupling groove, a recessed portion disposed in an outer upper side of the first pressure block and a step respectively disposed in an outer upper side of the second pressure block. Each fastener includes a base panel having a front baffle and a rear baffle at two opposite sides, a partition rib spaced between the front and rear baffles, and a hooked portion curved from the top of the partition rib.

7 Claims, 7 Drawing Sheets

(56) References Cited

U.S. PATENT DOCUMENTS

| | | | | |
|---|---|---|---|---|
| 2007/0151189 | A1* | 7/2007 | Yang | E04F 15/02 52/582.2 |
| 2009/0071090 | A1* | 3/2009 | Yang | E04F 15/02 52/588.1 |
| 2009/0107076 | A1* | 4/2009 | Kim | E04F 15/02 52/582.1 |
| 2009/0151290 | A1* | 6/2009 | Liu | E04F 15/04 52/586.1 |
| 2011/0016815 | A1* | 1/2011 | Yang | E04F 15/02 52/396.04 |
| 2013/0167467 | A1* | 7/2013 | Vermeulen | E04F 15/02 52/588.1 |

* cited by examiner

FLOORBOARD ASSEMBLY

BACKGROUND OF THE INVENTION

1. Field of the Invention

The present invention relates to upholstery technology and more particularly, to a floorboard assembly that uses fasteners to fasten floor boards for flooring.

2. Description of the Related Art

Conventional high beam frame construction methods for hardwood flooring are time consuming and costly. In recent years, with the construction quality improvement, the flooring technique of directly laying hardwood floor boards over an existing floor has been gradually adopted by the people. Before installing hardwood floor boards over a floor, people normally will apply a layer of glue to the floor, and then lay hardwood floor boards over the floor. However, applying a layer of glue to the floor is expensive and not environmentally friendly.

The inventor of the present invention created a design of floorboard assembly for laying rectangular floor boards over an existing floor transversely and longitudinally without glue. According to this design, as seen in Taiwan Patent M271046, the floorboard assembly consists of a plurality of floor boards and fasteners. Each floor board comprises a first coupling portion and a second coupling portion. When fastening each two adjacent floor boards during the floorboard installation operation, engage one end of each fastener into the second coupling portion of one floor board, and then engage the other end of each fastener into the first coupling portion of the other floor board, and then affix wood screws to the fasteners and the two floor boards. According to this design, it needs to affix wood screws to the fasteners and the floor boards, thus, there is still room for improvement.

In order to eliminate the drawbacks of the aforesaid prior art design of floorboard assembly, U.S. Pat. No. 7,805,903 discloses a locking system for floor boards. This improved design eliminates the use of wood screws. However, in order to enable the locking devices to be smoothly hooked on the floor boards, a gap is left between the horizontal platform of the third protruding gripping extension of each locking device and the tongue of the mating floor board, however, this structural design can lead to loosening of the locking devices from the floor boards. In order to overcome this problem, a tooth is formed on the top of the second protruding gripping extension for jamming into the surface of the locking groove of the mating floor board to prevent locking device loosening. However, jamming the tooth into the surface of the floor board can cause a destructive damage to the floor board, making the floor board difficult to re-use.

In view of the aforesaid various problems, the inventor of the present invention disclosed another improved design of floorboard assembly, entitled "Modular floor", which eliminates the use of wood screws or glue, or the design of a tooth for jamming into the surface of the floor board. However, when laying the modular floor over an existing floor that is not rectangular, for example, the floor in a house that has a main room 1 and a compartment 2 (or stairs, passageway, etc.), the worker generally will select one of the four sides of the main room 1 as a reference line 3, and then start the installation from the reference line 3 in direction toward the compartment 2. However, the assembled modular floor may be unable to fit the floor area of the main room 1 perfectly. In order to maintain the integrity and sense of beauty of the whole floor area of the main room 1, it is necessary to install decorative components over the floor area between the installed modular floor and the compartment 2, complicating the installation operation. In order to avoid this problem, the worker can take one partition wall between the main room 1 and the compartment 2 for defining a reference line 70, and then lay floor boards over the floor surface leftwards and rightwards from this reference line 70. However, prior art floorboard designs are simply suitable for installation over a floor surface in one single direction, not practical for installation in two reversed directions.

SUMMARY OF THE INVENTION

The present invention has been accomplished under the circumstances in view. It is the main object of the present invention to provide a floorboard assembly, which can be easily and conveniently assembled by engaging a coupling tongue of one floor board into a coupling groove of another floor board and hooking a hooked portion of each fastener on a recessed portion or step of each mating floor board, and simultaneously laid over the floor in two directions relative to a reference line and, which is practical for installation over an existing floor in any of a variety of room types.

To achieve this and other objects of the present invention, a floorboard assembly comprises a plurality of floor boards, a plurality of fasteners for securing the floor boards. Each floor board comprises a rectangular body. The rectangular body comprises a coupling tongue longitudinally extending along one long side thereof, a coupling groove longitudinally extending along an opposite long side thereof, a first pressure block longitudinally located at a bottom side relative to the coupling tongue, a second pressure block longitudinally located at a bottom side relative to the coupling groove, a recessed portion longitudinally disposed in an outer upper side of the first pressure block adjacent to the coupling tongue, a step longitudinally extending along an outer upper side of the second pressure block adjacent to the coupling groove, and a backplane located at a bottom side thereof between the first pressure block and the second pressure block. Further, the distance between the first pressure block and the recessed portion is equal to the distance between the second pressure block and the step. Further, the coupling tongue of one floor board is engageable into the coupling groove of another floor board. Each fastener comprises a base panel, a first elastic member, a second elastic member and a third elastic member. The base panel comprises a front baffle and a rear baffle respectively raised from and extended along two opposing lateral sides of a top wall thereof, a partition rib raised from the top wall and spaced between the front baffle and the rear baffle, a hooked portion curved from a top end of the partition rib in direction toward the rear baffle for selectively hooking on the step or recessed portion of one floor board, a first accommodation open chamber defined between the front baffle and the partition rib for selectively accommodating one of the first pressure block and second pressure block of one floor board and a second accommodation open chamber defined between the rear baffle and the partition rib for selectively accommodating one of the second pressure block and first pressure block of another floor board. The first elastic member is attached to an inner side of the front baffle to face toward the partition rib. The second elastic member is attached to an inner side of the rear baffle to face toward the partition rib. The third elastic member is attached to one lateral side of the partition rib to face toward the front baffle.

Preferably, the recessed portion is disposed between the first pressure block and the coupling tongue; the step is disposed between the second pressure block and the coupling groove.

Preferably, the hooked portion of each fastener has a top surface thereof configured for stopping against a bottom surface of the coupling tongue of one said floor board.

Preferably, the recessed portion and step of each floor board are disposed in the same plane.

Preferably, each fastener further comprises a first locating groove located on the inner side of the front baffle thereof for accommodating the first elastic member, a second locating groove located on the inner side of the rear baffle thereof and facing toward the partition rib for accommodating the second elastic member, and a third locating groove located on one side of the partition rib and facing toward the front baffle for accommodating the third elastic member.

Preferably, the first locating groove, the second locating groove and the third locating groove are respectively located on the front baffle, the rear baffle and the partition rib on a middle part thereof.

Preferably, the partition rib is raised from the top wall of the base panel perpendicularly.

Preferably, the distance between the front baffle and the partition rib is equal to the distance between the rear baffle and the partition rib.

Thus, by means of engaging the coupling tongue of one floor board into the coupling groove of another floor board and selectively hooking the hooked portion of each fastener on the recessed portion or step of one respective floor board, the floor boards of the floorboard assembly are firmly secured together. Thus, the floorboard assembly can be conveniently assembled for installation over an existing floor in any of a variety of room types.

Other advantages and features of the present invention will be fully understood by reference to the following specification in conjunction with the accompanying drawings, in which like reference signs denote like components of structure.

DETAILED DESCRIPTION OF THE INVENTION

Referring to FIGS. 1-4, a floorboard assembly 10 in accordance with the present invention is shown. The floorboard assembly 10 comprises a plurality of floor boards 30, and a plurality of fasteners 50.

Figure 3:
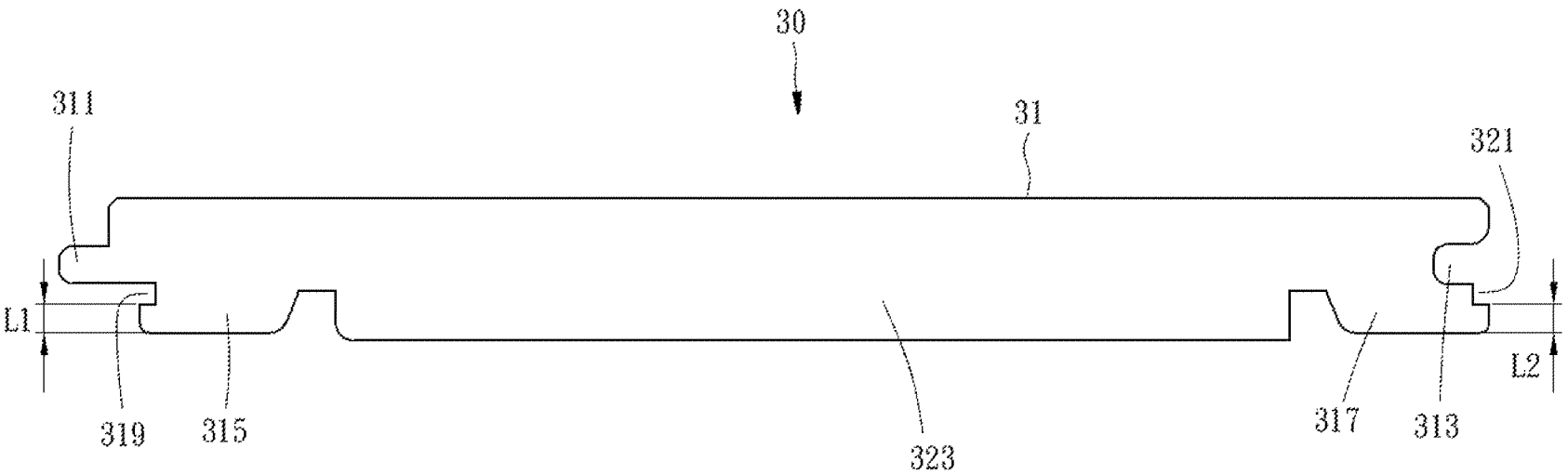
FIG. 3 is a sectional view of one floor board for floorboard assembly in accordance with the present invention.

Each floor board 30 comprises a rectangular body 31. The rectangular body 31 comprises a coupling tongue 311 longitudinally extending along one long side thereof, a coupling groove 313 longitudinally extending along an opposite long side thereof, a first pressure block 315 longitudinally located at a bottom side relative to the coupling tongue 311, a second pressure block 317 longitudinally located at a bottom side relative to the coupling groove 313, a recessed portion 319 longitudinally disposed in an outer upper side of the first pressure block 315 adjacent to the coupling tongue 311, a step 321 longitudinally extending along an outer upper side of the second pressure block 317 adjacent to the coupling groove 313, and a backplane 323 located at a bottom side thereof between the first pressure block 315 and the second pressure block 317, as shown in FIG. 3. Further, the distance L1 between the first pressure block 315 and the recessed portion 319 is equal to the distance L2 between the second pressure block 317 and the step 321.

Multiple floor boards 30 can be assembled together to form one floorboard assembly 10 by engaging the coupling tongue 311 of one floor board 30 into the coupling groove 313 of another floor board 30. This assembling method prevents the floorboard assembly 10 from deformation due to damp or pressure. Further, the recessed portion 319 is disposed between the first pressure block 315 and the coupling tongue 311; the step 321 is disposed between the second pressure block 317 and the coupling groove 313; the recessed portion 319 and the step 321 are disposed in the same horizontal plane.

Figure 4:
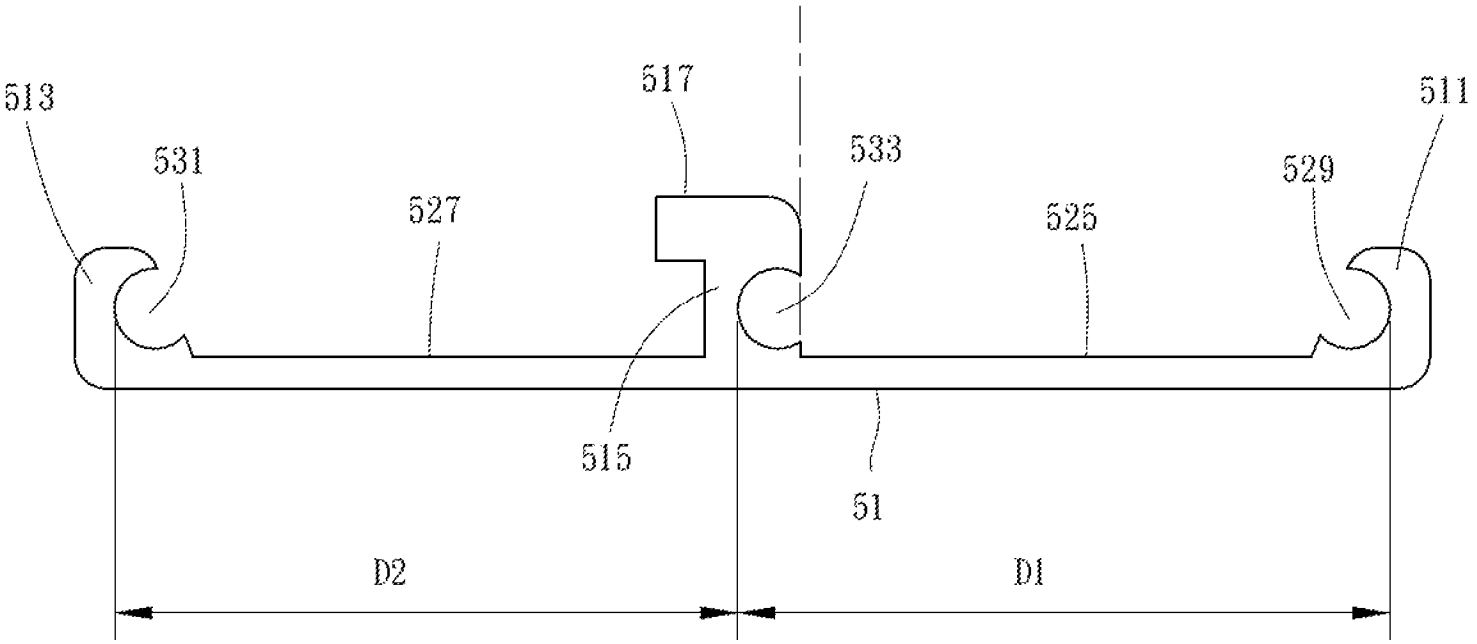
FIG. 4 is a sectional view of one fastener for floorboard assembly in accordance with the present invention.
Figure 5A:
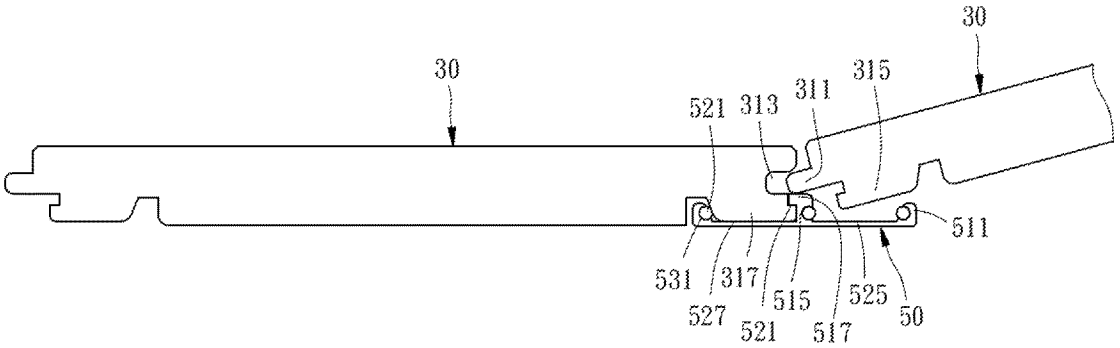
FIGS. 5A and 5B are schematic drawings illustrating the installation of a floorboard over a floor area at a right side relative to a reference line in accordance with the present invention.
Figure 5B:
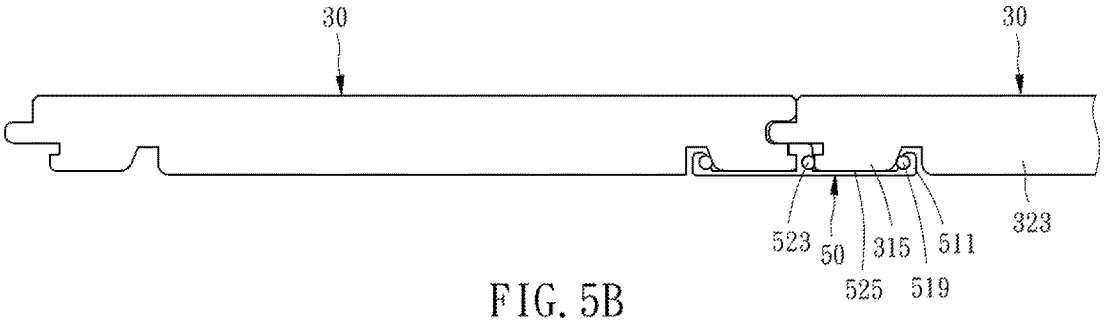
Figure 6A:
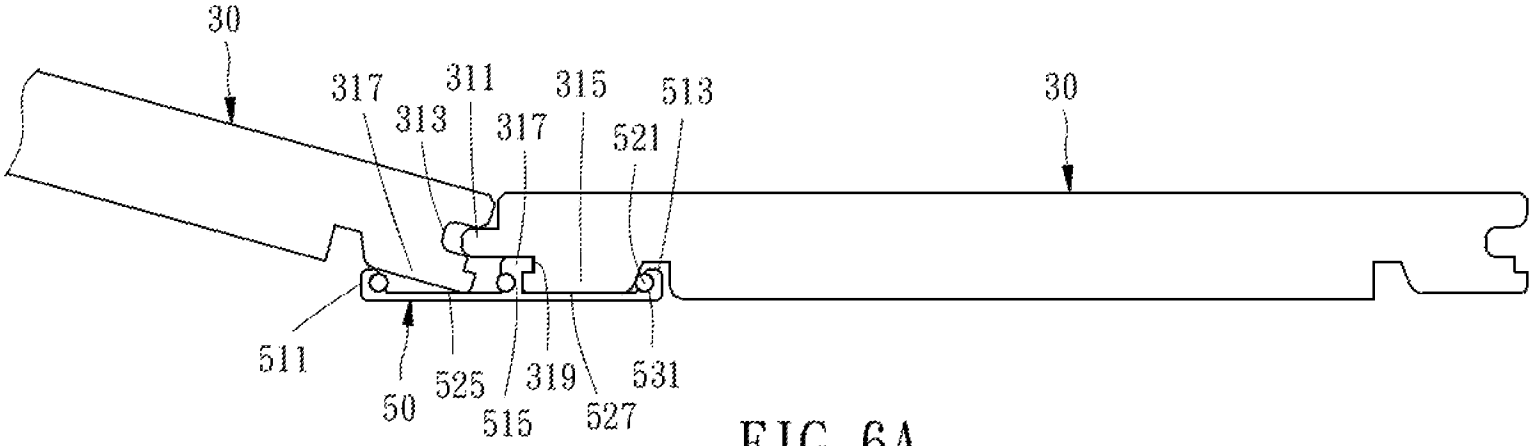
FIGS. 6A and 6B are schematic drawings illustrating the installation of a floorboard over a floor area at a left side relative to the reference line in accordance with the present invention.
Figure 6B:
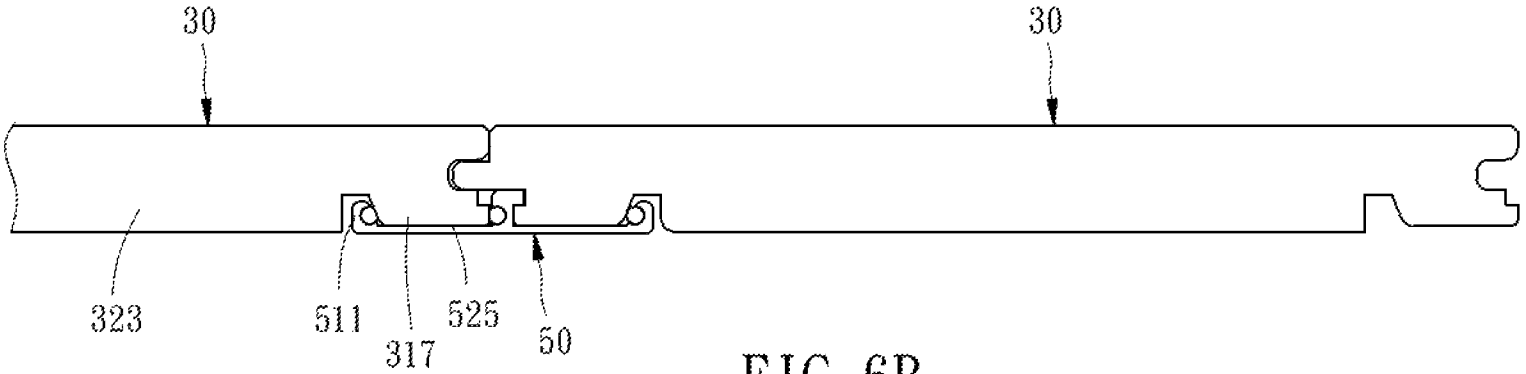

Each fastener 50, as shown in FIG. 4, comprises a base panel 51, a first elastic member 519, a second elastic member 521, and a third elastic member 523. The base panel 51 comprises a front baffle 511 and a rear baffle 513 respectively raised from and extended along two opposing lateral sides of a top wall thereof, a partition rib 515 perpendicularly raised from the top wall and spaced between the front baffle 511 and the rear baffle 513, a hooked portion 517 curved from the topmost end of the partition rib 515 in direction toward the rear baffle 513, a first accommodation open chamber 525 defined between the front baffle 511 and the partition rib 515, and a second accommodation open chamber 527 defined between the rear baffle 513 and the partition rib 515. The first elastic member 519 is attached to an inner side of the front baffle 511 to face toward the partition rib 515. The second elastic member 521 is attached to an inner side of the rear baffle 513 to face toward the partition rib 515. The third elastic member 523 is attached to one lateral side of the partition rib 515 to face toward the front baffle 511. Further, the distance D1 between the front baffle 511 and the partition rib 515 is equal to the distance D2 between the rear baffle 513 and the partition rib 515. Further, the first accommodation open chamber 525 and the second accommodation open chamber 527 are respectively adapted for accommodating the first pressure block 315 and second pressure block 317 of one floor board 30. The hooked portion 517 is adapted for hooking on the step 321 or recessed portion 319 of one floor board 30. After hooking of the hooked portion 517 on the recessed portion 319 of one floor board 30, the hooked portion 517 is stopped with a top surface thereof against a bottom surface of the coupling tongue 311 of the associating floor board 30 to impart an upward supporting force to the coupling tongue 311. In other words, when installing a floorboard assembly over a floor in a square room or a room without partition wall, the hooked portion 517 of each fastener 50 can be selectively hooked on the step 321 or recessed portion 319 of one respective floor board 30. However, when installing a floorboard assembly over a floor in a room shaped like that shown in FIG. 1, the hooked portion 517 of each fastener 50 should be hooked on the step 321 of the associating floor board 30 that is laid over the floor area at the right side relative to the reference line 70, and the hooked portion 517 of each fastener 50 should be hooked on the recessed portion 319 of the associating floor board 30 that is laid over the floor area at the left side relative to the reference line 70. Preferably, each fastener 50 further comprises a first locating groove 529 located on a middle part of the inner side of the front baffle 511 and facing toward the partition rib 515 for receiving the first elastic member 519, a second locating groove 531 located on a middle part of the inner side of the rear baffle 513 and facing toward the partition rib 515 for receiving the second elastic member 521, and a third locating groove 533 located on a middle part of one side of the partition rib 515 and facing toward the front baffle 511 for receiving the third elastic member 523.

Figure 1:
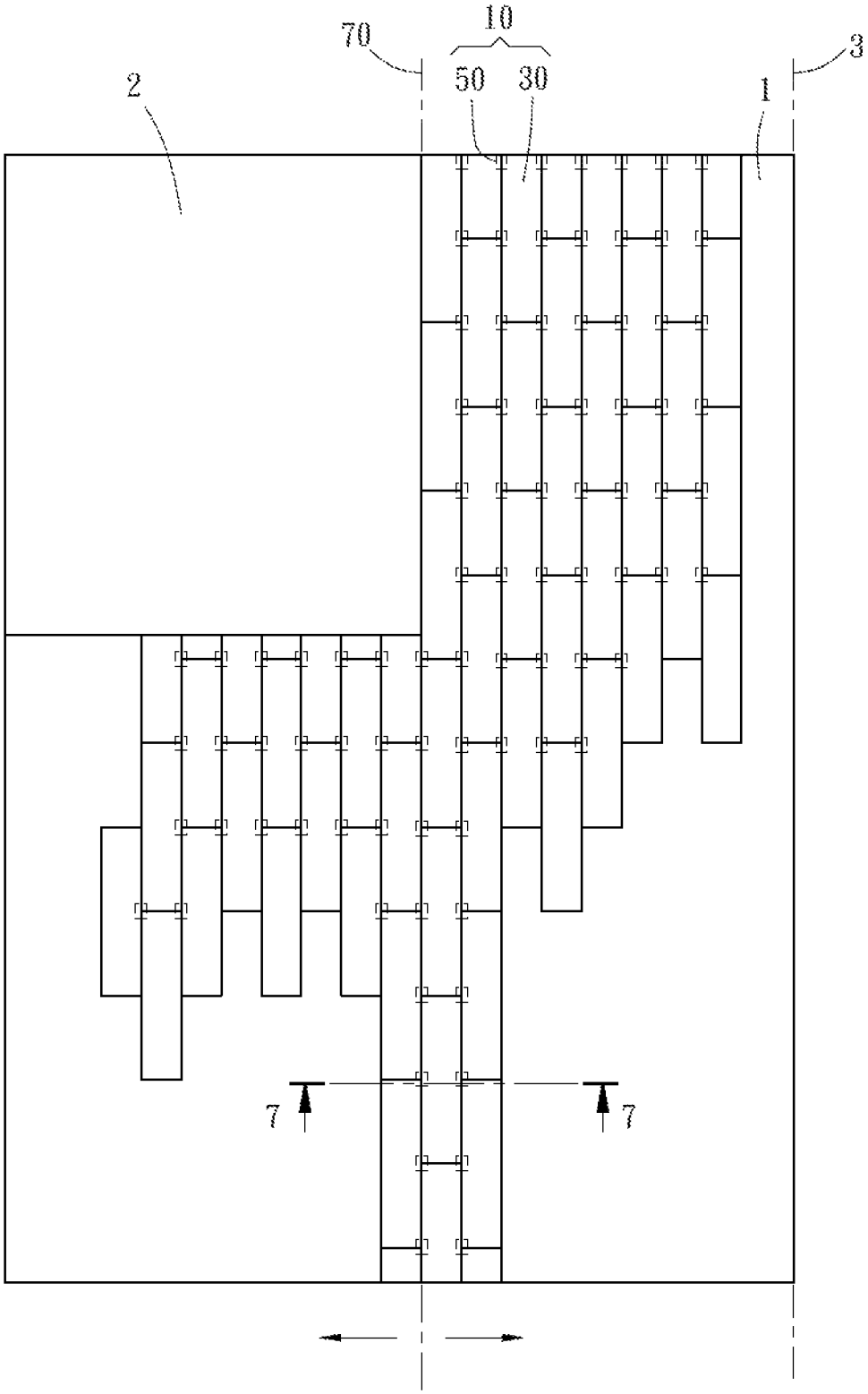
FIG. 1 is a schematic top view illustrating the installation of a floorboard assembly in a particular type of room in accordance with the present invention.
Figure 2:
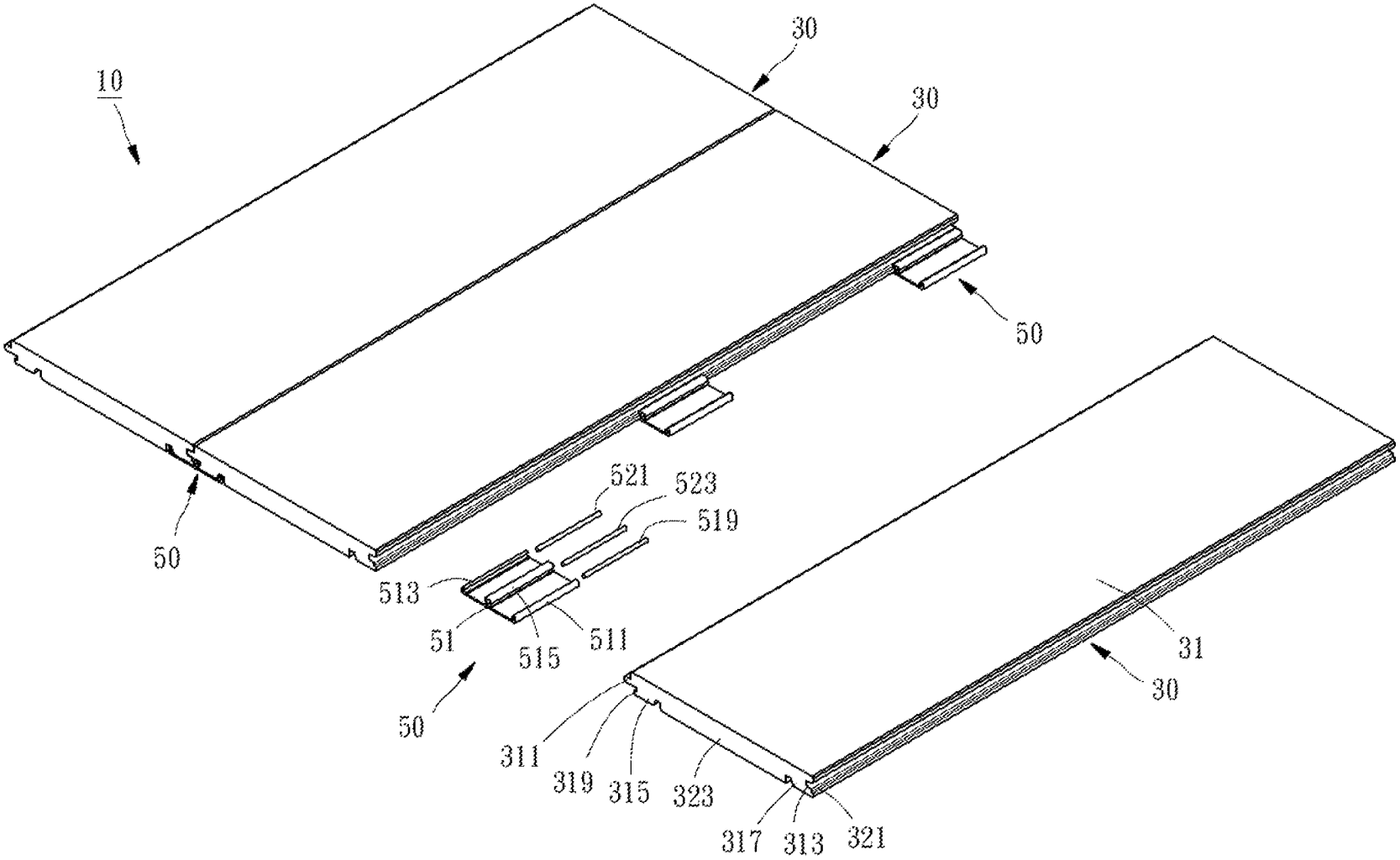
FIG. 2 is an elevational exploded view of the floorboard assembly in accordance with the present invention.
Figure 7:
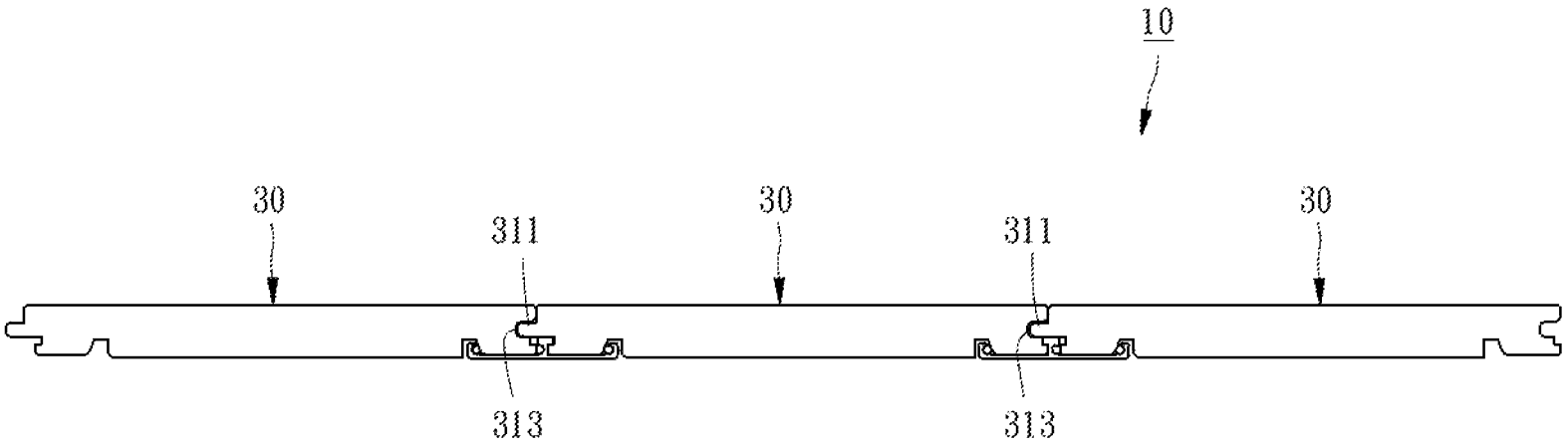
FIG. 7 is a sectional view taken along line 7-7 of FIG. 1.

Referring to FIGS. 2-6, the desired floorboard assembly 10 can be assembled and installed in the room shown in FIG. 1 in, but not limited to, the method described hereinafter. With the part for the area at the right side relative to the reference line 70, as shown in FIGS. 5A and 5B, attach the fastener 50 to the second pressure block 317 of one first floor board 30 to hook the hooked portion 517 on the step 321 and to let the second pressure block 317 of this first floor board 30 be firmly accommodated in the second accommodation open chamber 527 and stopped between the second elastic member 521 in the second locating groove 531 at the rear baffle 513 of the fastener 50 and partition rib 515 of the respective fastener 50, thereafter, obliquely insert the coupling tongue 311 of a second floor board 30 into the coupling groove 313 of the aforesaid first floor board 30 and then bias this second floor board 30 to a horizontal position to force the first pressure block 315 of this second floor board 30 into the first accommodation chamber 525 of the fastener 50 and to let the front baffle 511 of the fastener 50 be abutted against one lateral side of the backplane 323 of this second floor board 30, enabling the first elastic member 519 and third elastic member 523 of the fastener 50 to fill up the gap between the first pressure block 315 of this second floor board 30 and the first accommodation chamber 525 of the fastener 50, and thus, the first pressure block 315 of this second floor board 30 and the first accommodation chamber 525 of the fastener 50 are firmly secured together. With the part for the area at the left side relative to the reference line 70, as shown in FIGS. 6A and 6B, attach the fastener 50 to the first pressure block 315 of one first floor board 30 to hook the hooked portion 517 on the recessed portion 319 and to let the first pressure block 315 of this first floor board 30 be firmly accommodated in the second accommodation open chamber 527 and stopped between the second elastic member 521 member 521 in the second locating groove 531 at the rear baffle 513 and the partition rib 515, thereafter, obliquely attach the coupling groove 313 of a second floor board 30 onto the coupling tongue 311 of the aforesaid first floor board 30 and then bias this second floor board 30 to a horizontal position to force the second pressure block 317 of this second floor board 30 into the first accommodation chamber 525 of the fastener 50 and to let the front baffle 511 of the front baffle 511 of the fastener 50 be abutted against one lateral side of the backplane 323 of this second floor board 30. When assembled, as shown in FIG. 7, a clearance is left between the coupling tongue 311 of each floor board 30 and the coupling groove 313 of the mating adjacent floor board 30, and another clearance is also left between the respective mating lateral sides of each two adjacent floor boards 30 to avoid the deformation of the assembled floorboard assembly 10 caused by moisture.

With the structure described above, engagement between the coupling tongue 311 one floor board 30 and the coupling groove 313 of the mating adjacent floor board 30 gives support to the assembled floorboard assembly 10, preventing deformation due to pressure or negligent installation of the fastener 50. Even if the fasteners 50 are not accurately installed in position, the assembled floorboard assembly 10 can still be maintained planar, preventing subsidence. Further, when laying floor boards over a floor surface in a special type of room (as shown in FIG. 1), either in a rightward direction leftward direction from the reference line 70, the first accommodation open chamber 525 and second accommodation open chamber 527 of each fastener 50 can secure the first pressure block 315 or second pressure block 317 of the mating floor board 30 firmly, holding each two adjacent floor boards 30 tightly together. Thus, the invention facilitates the installation of the floorboard assembly 10 over a floor surface in any type of room. Further, the design of the partition rib 515 enables a proper clearance to be left between each two transversely abutted floor boards 30, preventing the assembled floorboard assembly 10 from deformation due to damp or thermal expansion and contraction.

Although a particular embodiment of the invention has been described in detail for purposes of illustration, various modifications and enhancements may be made without departing from the spirit and scope of the invention. Accordingly, the invention is not to be limited except as by the appended claims.

What is claimed is:

1. A floorboard assembly, comprising:

a plurality of floor boards, each said floor board comprising a rectangular body, said rectangular body comprising a coupling tongue longitudinally extending along one long side thereof, a coupling groove longitudinally extending along an opposite long side thereof, a first pressure block longitudinally located at a bottom side relative to said coupling tongue, a second pressure block longitudinally located at a bottom side relative to said coupling groove, a recessed portion longitudinally disposed in an outer upper side of said first pressure block adjacent to said coupling tongue, a step longitudinally extending along an outer upper side of said second pressure block adjacent to said coupling groove, and a backplane located at a bottom side thereof between said first pressure block and said second pressure block, the distance between a bottom surface of said first pressure block and said recessed portion being equal to the distance between a bottom surface of said second pressure block and said step, the coupling tongue of one said floor board being engageable into the coupling groove of another said floor board; and a plurality of fasteners for securing said floor boards, each said fastener comprising a base panel, a first elastic member, a second elastic member and a third elastic member, said base panel comprising a front baffle and a rear baffle respectively raised from and extended along two opposing lateral sides of a top wall thereof, a partition rib raised from the top wall and spaced between said front baffle and said rear baffle, a hooked portion curved from a top end of said partition rib in direction toward said rear baffle for selectively hooking on the step or recessed portion of one said floor board, a first accommodation open chamber defined between said front baffle and said partition rib for selectively accommodating one of the first pressure block and second pressure block of one said floor board and a second accommodation open chamber defined between said rear baffle and said partition rib for selectively accommodating one of the second pressure block and first pressure block of another said floor board, said first elastic member being attached to an inner side of said front baffle to face toward said partition rib, said second elastic member being attached to an inner side of said rear baffle to face toward said partition rib, said third elastic member being attached to one lateral side of said partition rib to face toward said front baffle, wherein said hooked portion of each said fastener has a top surface thereof configured for stopping against a bottom surface of the coupling tongue of one said floor board.

2. The floorboard assembly as claimed in claim 1, wherein said recessed portion is disposed between said first pressure block and said coupling tongue; said step is disposed between said second pressure block and said coupling groove.

3. The floorboard assembly as claimed in claim 1, wherein the recessed portion and step of each said floor board are disposed in the same plane.

4. The floorboard assembly as claimed in claim 1, wherein each said fastener further comprises a first locating groove located on the inner side of the front baffle thereof for accommodating said first elastic member, a second locating groove located on the inner side of the rear baffle thereof and facing toward said partition rib for accommodating said second elastic member, and a third locating groove located on one side of said partition rib and facing toward said front baffle for accommodating said third elastic member.

5. The floorboard assembly as claimed in claim 4, wherein said first locating groove, said second locating groove and said third locating groove are respectively located on said front baffle, said rear baffle and said partition rib on a middle part thereof.

6. The floorboard assembly as claimed in claim 1, wherein said partition rib is raised from the top wall of said base panel perpendicularly.

7. The floorboard assembly as claimed in claim 1, wherein the distance between said front baffle and said partition rib is equal to the distance between said rear baffle and said partition rib.

* * * * *